US005573389A

United States Patent [19]

Fukuhara et al.

[11] Patent Number: 5,573,389

[45] Date of Patent: Nov. 12, 1996

[54] SCROLL COMPRESSOR HAVING MEANS FOR BIASING AN ECCENTRIC BEARING TOWARDS A CRANK SHAFT

[75] Inventors: Hiroyuki Fukuhara; Sadayuki Yamada, both of Otsu; Shigeru Muramatsu, Kusatsu; Tatsuya Hori, Fujisawa, all of Japan

[73] Assignee: Matsushita Electric Industrial Co., Ltd., Osaka-fu, Japan

[21] Appl. No.: 529,641

[22] Filed: Sep. 18, 1995

[30] Foreign Application Priority Data

Sep. 19, 1994 [JP] Japan ..... 6-222851

[51] Int. Cl.[6] ..... F01C 1/04

[52] U.S. Cl. ..... 418/55.5; 418/57

[58] Field of Search ..... 418/55.5, 57

[56] References Cited

U.S. PATENT DOCUMENTS

| | | | |
|---|---|---|---|
| 4,764,096 | 8/1988 | Sawai et al. | 418/55.5 |
| 5,328,324 | 7/1994 | Ishii et al. | 418/55.5 |
| 5,378,129 | 1/1995 | Dunaevsky et al. | 418/55.5 |

FOREIGN PATENT DOCUMENTS

| | | | |
|---|---|---|---|
| 5164083 | 6/1993 | Japan | 418/57 |

*Primary Examiner*—Charles Freay

*Attorney, Agent, or Firm*—Wenderoth, Lind & Ponack

[57] ABSTRACT

A scroll compressor includes a compression mechanism having a stationary scroll and an orbiting scroll in engagement with each other, a crank shaft for causing orbiting of the scroll relative to the stationary scroll, a bearing member for rotatably supporting the crank shaft and having a thrust bearing for axially supporting the orbiting scroll, an electric motor for driving the crank shaft, and an eccentric bearing radially movably accommodated within a recess defined in an end portion of the crank shaft. The orbiting scroll has a shaft journaled in the eccentric bearing. A leaf spring is interposed between the eccentric bearing and a side wall of the recess for pressing the eccentric bearing radially outwardly. The eccentric bearing has inclined planes defined on an external surface thereof for receiving a biasing force of the leaf spring so that an axial component of the biasing force is directed towards the crank shaft. Instead of forming the inclined planes on the eccentric bearing, an inclined plane may be formed on a pressure member mounted on the eccentric bearing.

11 Claims, 11 Drawing Sheets

SCROLL COMPRESSOR HAVING MEANS FOR BIASING AN ECCENTRIC BEARING TOWARDS A CRANK SHAFT

BACKGROUND OF THE INVENTION

1. Field of the Invention

The present invention relates to a scroll compressor suited for use in, for example, an air conditioner, a refrigerator or the like for business or domestic use.

2. Description of Related Art

Electrically-operated compressors are available in various types including a reciprocating type, a rotary type, a scroll type, and the like, and are widely used in air conditioners, refrigerators and the like. The reciprocating or rotary compressors are characterized by high performance or low cost, while the scroll compressors are characterized by low noise or low vibration. A typical example of the scroll compressors is disclosed in Japanese Laid-open Patent Publication (unexamined) No. 62-168986.

With reference to FIG. 17, the scroll compressor generally comprises a closed vessel 1 and a compression mechanism 4 accommodated within an upper portion of the closed vessel 1. The compression mechanism 4 includes a stationary scroll 2 having a stationary scroll wrap 2*a* integrally formed therewith and an orbiting scroll 3 having an orbiting scroll wrap 3*a* integrally formed therewith, with the stationary and orbiting scroll wraps 2*a* and 3*a* being in engagement with each other. The orbiting scroll 3 has a shaft 7 integrally formed therewith and journaled in an eccentric bearing 10, which is rectangular in external shape and is in turn accommodated within a recess 9 defined in an upper end portion of a crank shaft 8. An upper portion of the crank shaft 8 is supported by a bearing member 6 with which a thrust bearing 5 is integrally formed to axially support the orbiting scroll 3. The eccentric bearing 10 is allowed to radially move to reduce an orbiting radius of the orbiting scroll 3 but is biased by a leaf spring 11 to maintain the maximum orbiting radius. An electric motor 12 is disposed below the bearing member 6 and is made up of a rotor 13 securely mounted on the crank shaft 8 and a stator 14 rigidly secured to the closed vessel 1 by shrink fitting. The crank shaft 8 is supported by a main bearing 15 and an auxiliary bearing 16 both interposed between it and the bearing member 6, and is driven by the electric motor 12 to cause the orbiting scroll 3 to undergo an orbiting motion relative to the stationary scroll 2.

The closed vessel 1 is provided at its bottom portion with an oil storage portion 18 for storing lubricating oil 17 and at its side portion with a suction pipe 19 rigidly secured thereto for introducing a low-pressure refrigerant thereinto. The closed vessel 1 also accommodates a ring-shaped spacer 20 sealingly welded thereto, below which the pressure of suction gas, i.e., the low-pressure refrigerant acts and above which the pressure of compressed gas, i.e., a high-pressure refrigerant acts. The bearing member 6 has an oil discharge conduit 21 defined therein for discharging the lubricating oil 17 which has lubricated and cooled the main bearing 15, the auxiliary bearing 16, the eccentric bearing 10, and the thrust bearing 5. The bearing member 6 also has a suction hole 29 defined therein through which the low-pressure refrigerant introduced into the closed vessel 1 is supplied to the compression mechanism 4. The stationary scroll 2 and the bearing member 6 are connected to each other via the spacer 20 by means of bolts. The crank shaft 8 has a through-hole 22 defined therein along a longitudinal axis thereof for supplying the main bearing 15, the auxiliary bearing 16, the eccentric bearing 10, and the thrust bearing 5 with the lubricating oil 17 to lubricate and cool them. The crank shaft 8 also has an oil guide 23 mounted on a lower end thereof for sucking up the lubricating oil 17 through the through-hole 22. The closed vessel 1 has a discharge chamber 24 defined therein above the stationary scroll 2.

The scroll compressor shown in FIG. 17 also includes a discharge pipe 25 rigidly secured to the closed vessel 1 for discharging compressed high-pressure refrigerant to the outside of the closed vessel 1, a check valve 26 mounted on the stationary scroll 2 for preventing contrarotation of the orbiting scroll 3 when the scroll compressor is stopped, a valve guide 27 disposed above the check valve 26 and bolted to the stationary scroll 2 for restricting a vertical movement of the check valve 26, and an Oldham ring 28 for preventing the orbiting scroll 3 from rotating about its own axis while permitting it to undergo an orbiting motion relative to the stationary scroll 2.

The scroll compressor of the above-described construction operates as follows.

A low-pressure refrigerant is first introduced into the closed vessel 1 through the suction pipe 19 and then into the compression mechanism 4 through the suction hole 29. An orbiting motion of the orbiting scroll 3 relative to the stationary scroll 2 compresses the low-pressure refrigerant into a high-pressure refrigerant, which is in turn introduced into the discharge chamber 24. The high-pressure refrigerant thus obtained is discharged to the outside of the closed vessel 1 through the discharge pipe 25 to operate a working part. Upon operation of the working part, the high-pressure refrigerant is turned into a low-pressure refrigerant, which is returned back to the suction pipe 19, thus forming a known compression cycle.

On the other hand, lubricating oil 17 sucked up by the oil guide 23 moves upwardly along the through-hole 22 defined in the crank shaft 8, and lubricates and cools the main bearing 15, the auxiliary bearing 16, the eccentric bearing 10, and the thrust bearing 5. Thereafter, the lubricating oil 17 is discharged above the stator 14 through the oil discharge conduit 21 and is eventually returned back to the oil storage portion 18 through a groove 32 defined in the stator 14.

In order to enhance the reliability of the scroll compressor, it is necessary to stop not only generation of a liquid return phenomenon but also that of a liquid compression phenomenon following it. These phenomena are prone to take place in a transient state such as, for example, a process from the starting of the scroll compressor to the time a refrigerating cycle is stabilized, a process during which various operating conditions vary, or the like. The liquid return phenomenon is a phenomenon in which refrigerant turns to a liquid phase, while the liquid compression phenomenon takes place in the compression mechanism 4 and occasionally damages the stationary or orbiting scroll wrap 2*a* or 3*a*. A liquid-compression release mechanism is therefore indispensable to positively prevent damage of the stationary and orbiting scroll wraps 2*a* and 3*a*.

The liquid-compression release mechanism employed in the conventional scroll compressor is such that when the liquid compression phenomenon takes place, the eccentric bearing 10 is radially inwardly moved to reduce the orbiting radius of the orbiting scroll 3, thereby forming gaps between the stationary and orbiting scroll wraps 2*a* and 3*a* to discharge liquid entrapped in crescent-shaped working pockets defined therebetween. During the normal operation, the leaf spring 11 biases the eccentric bearing 10 radially outwardly to maintain the maximum orbiting radius.

However, when the eccentric bearing 10 is moved radially inwardly against a biasing force of the leaf spring 11 to reduce the orbiting radius, it sometimes occurs that the eccentric bearing 10 does not return to its original position but is axially slightly moved towards the orbiting scroll 3. If the operation is continued under a condition in which the eccentric bearing 10 remains at a position shifted toward the orbiting scroll 3, seizing of the eccentric bearing 10 is likely to take place due to a load variation or an inadequate lubrication caused by a change of flow of the lubricating oil, or an undesired contact of one end of the eccentric bearing 10 with an associated end of the orbiting scroll 3 is likely to generate abnormal noise or cause seizing, thus adversely affecting the reliability of the scroll compressor.

If the biasing force of the leaf spring 11 is strengthened to prevent an axial movement of the eccentric bearing 10, the problem arises that an undesired deformation of the eccentric bearing 10 reduces a clearance between the shaft 7 and the eccentric bearing 10 and subsequently causes seizing of the eccentric bearing 10. In order to avoid deformation of the eccentric bearing 10, if it is rigidified to have an increased physical strength, the weight and size thereof is increased, resulting in an increase in size of the scroll compressor.

SUMMARY OF THE INVENTION

The present invention has been developed to overcome the above-described disadvantages.

It is accordingly an objective of the present invention to provide a highly reliable scroll compressor having an improved eccentric bearing free from seizing or generation of abnormal noise.

In accomplishing the above and other objectives, the scroll compressor according to the present invention comprises a compression mechanism having a stationary scroll and an orbiting scroll in engagement with each other, a crank shaft for orbiting the orbiting scroll relative to the stationary scroll, a bearing member for rotatably supporting the crank shaft and having a thrust bearing for axially supporting the orbiting scroll, an electric motor for driving the crank shaft, and an eccentric bearing radially movably accommodated within a recess defined in an end portion of the crank shaft. The orbiting scroll has a shaft journaled in the eccentric bearing.

The scroll compressor of the above-described construction is characterized in that a biasing means is interposed between the eccentric bearing and a side wall of the recess for pressing the eccentric bearing radially outwardly, and in that the eccentric bearing has inclined planes defined on an external surface thereof for receiving a biasing force of the biasing means so that an axial component of the biasing force of the biasing means is directed towards the crank shaft.

According to the scroll compressor of the present invention, when the eccentric bearing is first moved radially inwardly against the biasing force of the biasing means to reduce an orbiting radius and is subsequently returned to its original position, the inclined planes formed on the eccentric bearing act to direct an axial component of the biasing force of the biasing means downwardly to press the eccentric bearing towards the crank shaft, thereby preventing an axial movement of the eccentric bearing towards the orbiting scroll.

Preferably, the side wall of the recess has an inclined plane held in contact with the biasing means to thereby effectively direct the axial component of the biasing force of the biasing means towards the crank shaft.

Advantageously, the biasing means comprises a generally U-shaped leaf spring having a back and two side portions continued thereto, which are held in contact with the side wall of the recess and the associated inclined planes of the eccentric bearing, respectively.

It is preferred that the back of the leaf spring is held in contact with the inclined plane of the side wall of the recess.

Instead of forming the inclined planes on the eccentric bearing, an inclined plane may be formed on a pressure member mounted on the eccentric bearing. The inclined plane of the pressure member causes the axial component of the biasing force of the biasing means to press the eccentric bearing against the crank shaft. In this case, the eccentric bearing is of a simple structure because it has no inclined planes.

It is preferred that the pressure member has a back and two side portions continued thereto with the inclined plane formed on the back of the pressure member. In this case, the two side portions of the pressure member are held in contact with associated side portions of the eccentric bearing so that the axial component of the biasing force of the biasing means acting on the pressure member may be positively transmitted to the eccentric bearing. If the side portions of the eccentric bearing are made thick, an undesired deformation of the eccentric bearing is avoided.

Advantageously, the eccentric bearing has two projections formed on a lower end thereof so as to extend radially outwardly therefrom to positively receive a lower edge of the pressure member. By so doing, the axial component of the biasing force of the biasing means is assuredly transmitted to the eccentric bearing via the two projections.

Again advantageously, the pressure member has a rib formed on a lower end thereof so as to extend radially outwardly therefrom. The rib rigidities the pressure member to more effectively transmit the biasing force of the biasing means to the eccentric bearing.

Instead of forming the two projections on the eccentric bearing, the pressure member has a rib formed on an upper end thereof so as to extend radially inwardly therefrom to press the eccentric bearing towards the crank shaft. This rib not only rigidities the pressure member but also effectively transmits the biasing force of the biasing means to the eccentric bearing.

Preferably, the pressure member has two projections formed on the side portions of the pressure member so as to extend radially inwardly therefrom to prevent a circumferential movement of the pressure member relative to the eccentric bearing.

Conveniently, the biasing means comprises a coil spring.

BRIEF DESCRIPTION OF THE DRAWINGS

The above and other objectives and features of the present invention will become more apparent from the following description of a preferred embodiment thereof with reference to the accompanying drawings, throughout which like parts are designated by like reference numerals, and wherein.

DETAILED DESCRIPTION OF THE PREFERRED EMBODIMENTS

Figure 1:
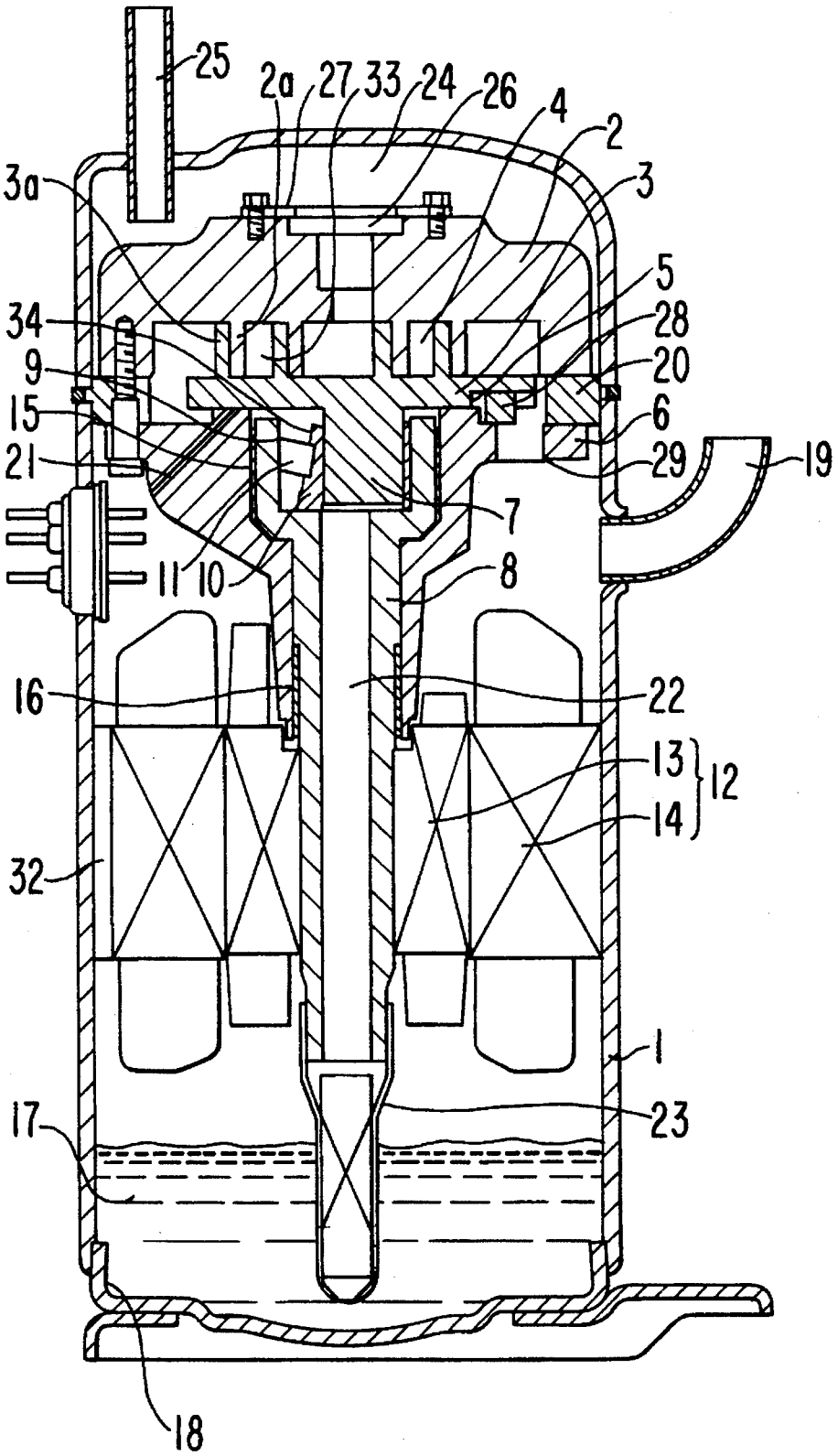
FIG. 1 is a vertical sectional view of a scroll compressor according to the present invention.

Referring now to the drawings, there is shown in FIG. 1 a scroll compressor according to the present invention.

The scroll compressor comprises a closed vessel 1 and a compression mechanism 4 accommodated within an upper portion of the closed vessel 1. The compression mechanism 4 includes a stationary scroll 2 having a stationary scroll wrap 2*a* integrally formed therewith and an orbiting scroll 3 having an orbiting scroll wrap 3*a* integrally formed therewith, with the stationary and orbiting scroll wraps 2*a* and 3*a* being in engagement with each other to define a plurality of crescent-shaped working pockets 33 therebetween. The orbiting scroll 3 has a shaft 7 integrally formed therewith and journaled in an eccentric bearing 10, which is rectangular in external shape and is in turn accommodated within a recess 9 defined in an upper end portion of a crank shaft 8. An upper portion of the crank shaft 8 is supported by a bearing member 6 with which a thrust bearing 5 is integrally formed to axially support the orbiting scroll 3.

The eccentric bearing 10 is allowed to radially move to reduce an orbiting radius of the orbiting scroll 3, but is biased by a leaf spring 11 interposed between the eccentric bearing 10 and a side wall of the recess 9 to maintain the maximum orbiting radius.

Figure 2A:
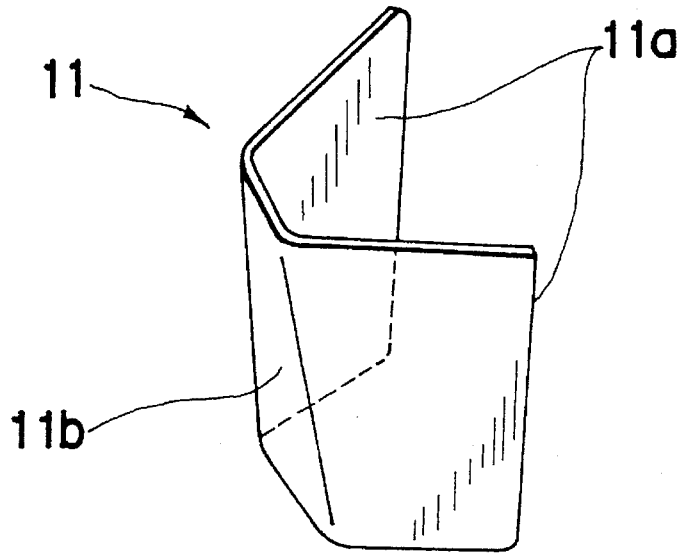
FIG. 2A is a perspective view of a leaf spring employed to bias an eccentric bearing mounted in the scroll compressor of FIG. 1.

FIG. 2A depicts an example of the leaf spring 11. As shown therein, the leaf spring 11 is bent generally in the form of a figure "U" and has two side portions 11*a* and a back 11*b* continuous therewith, which are to be held in contact with the eccentric bearing 10 and the side wall of the recess 9, respectively.

Figure 2B:
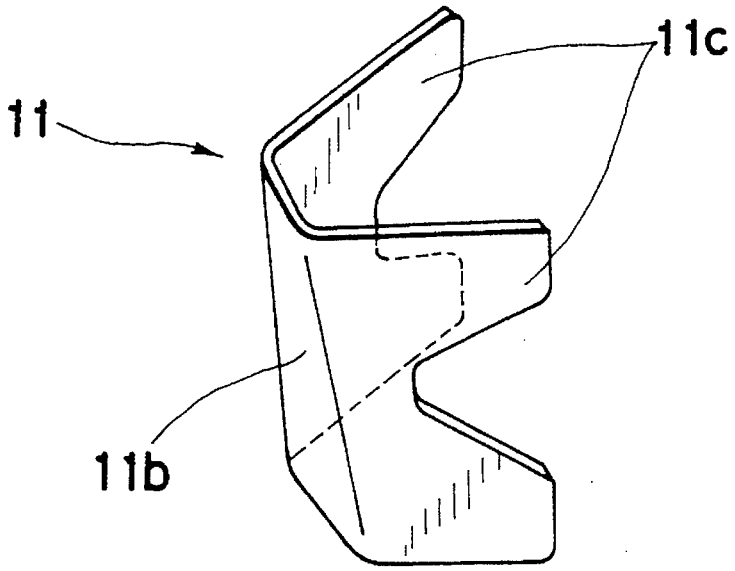
FIG. 2B is a view similar to FIG. 2A, but showing a modification thereof.

FIG. 2B depicts another example of the leaf spring 11. The leaf spring 11 of FIG. 2B has four fingers 11*c* and a back 11*b* continuous therewith, which are to be held in contact with the eccentric bearing 10 and the side wall of the recess 9, respectively.

Figure 3:
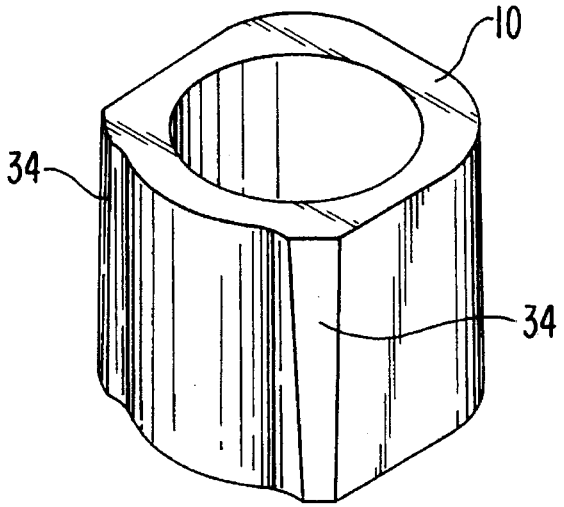
FIG. 3 is a perspective view of the eccentric bearing for use with the leaf spring of FIGS. 2A or 2B.
Figure 4:
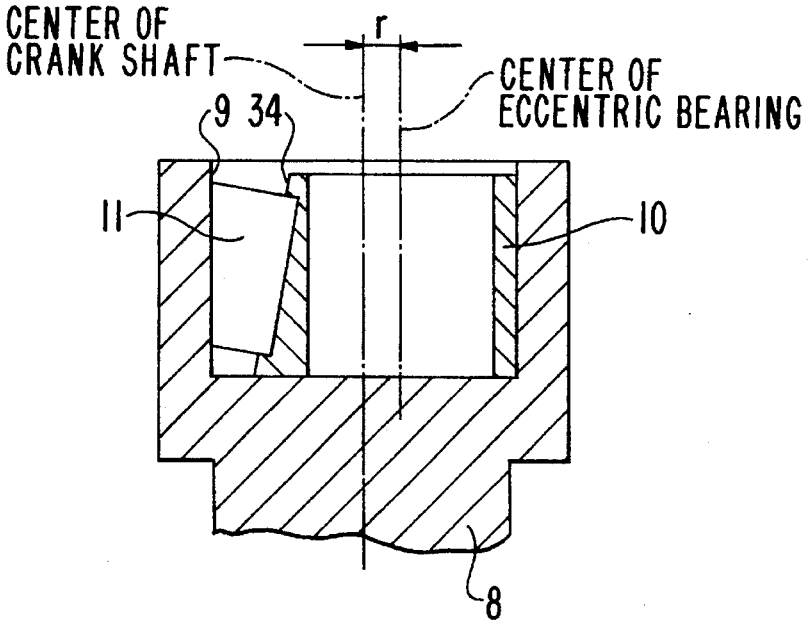
FIG. 4 is a vertical sectional view of an upper portion of a crank shaft having a recess defined therein in which the eccentric bearing is movably accommodated.

As shown in FIGS. 3 and 4, the eccentric bearing 10 has inclined planes 34 defined at two corners on an external surface thereof to receive a biasing force of the leaf spring 11 so that a vertical component of the biasing force may be directed downwardly to press the eccentric bearing 10 against a bottom wall of the recess 9.

An electric motor 12 is disposed below the bearing member 6 and is made up of a rotor 13 securely mounted on the crank shaft 8 and a stator 14 rigidly secured to the closed vessel 1 by shrink fitting. The crank shaft 8 is supported by a main bearing 15 and an auxiliary bearing 16 both interposed between it and the bearing member 6, and is driven by the electric motor 12 to cause the orbiting scroll 3 to undergo an orbiting motion relative to the stationary scroll 2.

The closed vessel 1 is provided at its bottom portion with an oil storage portion 18 for storing lubricating oil 17 and at its side portion with a suction pipe 19 rigidly secured thereto for introducing a low-pressure refrigerant thereinto. The closed vessel 1 also accommodates a ring-shaped spacer 20 sealingly welded thereto, below which the pressure of suction gas, i.e., the low-pressure refrigerant acts and above which the pressure of compressed gas, i.e., a high-pressure refrigerant acts. The bearing member 6 has an oil discharge conduit 21 defined therein for discharging the lubricating oil 17 which has lubricated and cooled the main bearing 15, the auxiliary bearing 16, the eccentric bearing 10, and the thrust bearing 5. The bearing member 6 also has a suction hole 29 defined therein through which the low-pressure refrigerant introduced into the closed vessel 1 is supplied to the compression mechanism 4. The stationary scroll 2 and the bearing member 6 are connected to each other via the spacer 20 by means of bolts. The crank shaft 8 has a through-hole 22 defined therein along a longitudinal axis thereof for supplying the main bearing 15, the auxiliary bearing 16, the eccentric bearing 10, and the thrust bearing 5 with the lubricating oil 17 to lubricate and cool them. The crank shaft 8 also has an oil guide 23 mounted on a lower end thereof for sucking up the lubricating oil 17 through the through-hole 22. The closed vessel 1 has a discharge chamber 24 defined therein above the stationary scroll 2.

The scroll compressor also includes a discharge pipe 25 rigidly secured to the closed vessel 1 for discharging compressed high-pressure refrigerant to the outside of the closed vessel 1, a check valve 26 mounted on the stationary scroll 2 for preventing contrarotation of the orbiting scroll 3 when the scroll compressor is stopped, a valve guide 27 disposed above the check valve 26 and bolted to the stationary scroll 2 for restricting a vertical movement of the check valve 26, and an Oldham ring 28 for preventing the orbiting scroll 3 from rotating about its own axis while permitting it to undergo an orbiting motion relative to the stationary scroll 2.

The scroll compressor of the above-described construction operates as follows.

A low-pressure refrigerant is first introduced into the closed vessel 1 through the suction pipe 19 and then into the working pockets 33 of the compression mechanism 4 through the suction hole 29. An orbiting motion of the orbiting scroll 3 relative to the stationary scroll 2 compresses the low-pressure refrigerant into a high-pressure refrigerant, which is in turn introduced into the discharge chamber 24. The high-pressure refrigerant thus obtained is discharged to the outside of the closed vessel 1 through the discharge pipe 25 to operate a working part. Upon operation of the working part, the high-pressure refrigerant is turned into a low-pressure refrigerant, which is returned back to the suction pipe 19, thus forming a known compression cycle.

On the other hand, lubricating oil 17 sucked up by the oil guide 23 moves upwardly along the through-hole 22 defined in the crank shaft 8, and lubricates and cools the main bearing 15, the auxiliary bearing 16, the eccentric bearing 10, and the thrust bearing 5. Thereafter, the lubricating oil 17 is discharged above the stator 14 through the oil discharge conduit 21 and is eventually returned back to the oil storage portion 18 through a groove 32 defined in the stator 14.

When the scroll compressor is in a transient state such as, for example, a process from the staring thereof to the time a refrigerating cycle is stabilized, a process during which various operating conditions vary, or the like, if a liquid return phenomenon takes place in which refrigerant having a liquid phase is circulated, the liquid refrigerant enters the compression mechanism 4 through the suction pipe 19 and the suction hole 29 and is then compressed in the working pockets 33 defined therein, resulting in an abrupt increase in pressure inside the working pockets 33. The abruptly increased pressure moves the eccentric bearing 10 in a direction to reduce the orbiting radius and produces radial gaps between the stationary and orbiting scroll wraps 2*a* and 3*a*. Because liquid compression is released by discharging the liquid introduced into the working pockets 33 from such gaps, the abruptly increased pressure is reduced. Thereafter, the eccentric bearing 10 is returned to its original position by the biasing force of the leaf spring 11 and continues the compression process while maintaining the maximum orbiting radius (r).

As described previously, because the eccentric bearing 10 has inclined planes 34 shown in FIG. 3 to which the biasing force of the leaf spring 11 is applied, an axial component of the biasing force of the leaf spring 11 is directed downwardly to press the eccentric bearing 10 against the bottom wall of the recess 9, thereby preventing an axial movement of the eccentric bearing 10 towards the orbiting scroll 3 and eliminating generation of seizing resulting therefrom.

Figure 5:
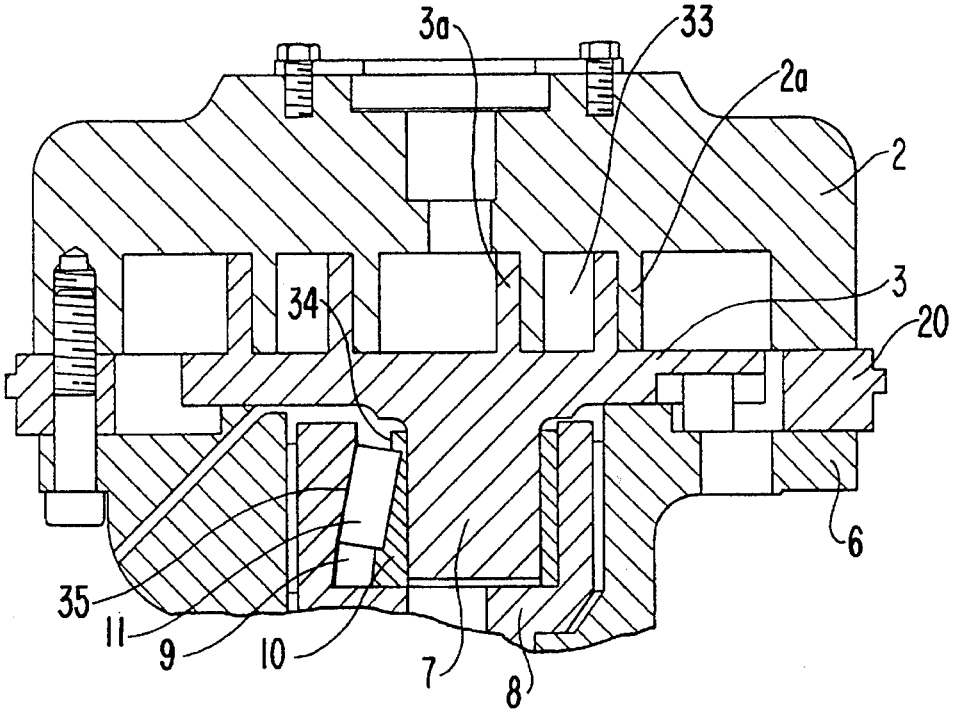
FIG. 5 is a vertical sectional view of an upper portion of the scroll compressor, particularly showing a modification thereof.

FIG. 5 depicts a modification of the present invention. As shown therein, it is preferred that the side wall of the recess 9 partially has an inclined inner plane 35 to be held in contact with the back 11*b* of the leaf spring 11. The inclined inner plane 35 of the side wall has an angle of inclination substantially identical to that of the inclined planes 34 of the eccentric bearing 10. The provision of the inclined inner plane 35 on the side wall of the recess 9 can more positively direct an axial component of the biasing force of the leaf spring 11 downwardly and, hence, can more effectively prevent an axial movement of the eccentric bearing 10 towards the orbiting scroll 3.

It is to be noted that although the leaf spring 11 shown in FIG. 2A or 2B has the back 11*b* inclined relative to edges of the two side portions 11*a* or those of the four fingers 11*c*, the leaf spring 11 shown in FIG. 5 has a back substantially parallel to such edges.

Figure 6:
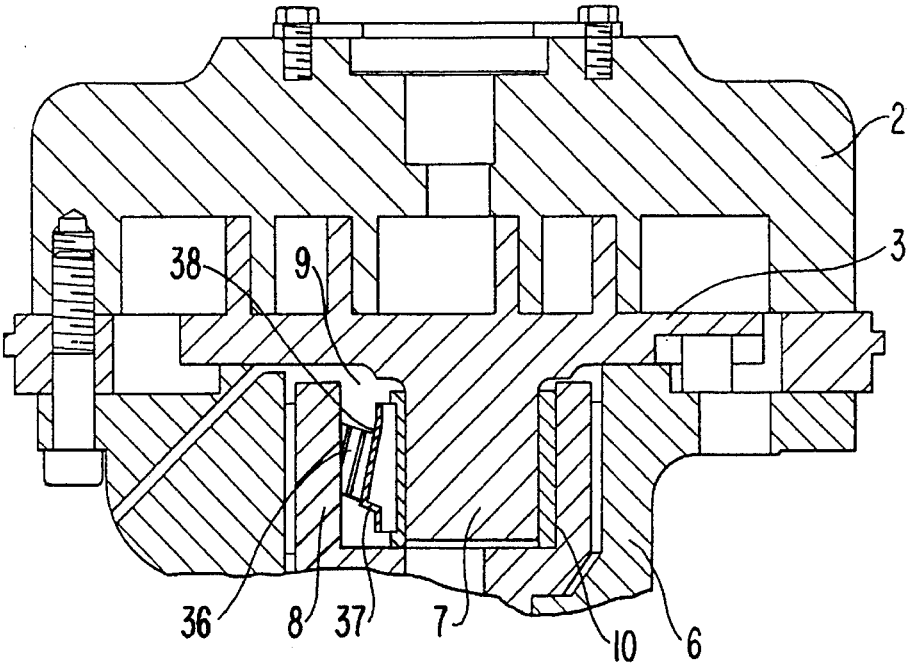
FIG. 6 is a view similar to FIG. 5, but showing another modification thereof including a pressure plate interposed between a side wall of the recess and the eccentric bearing.
Figure 9:
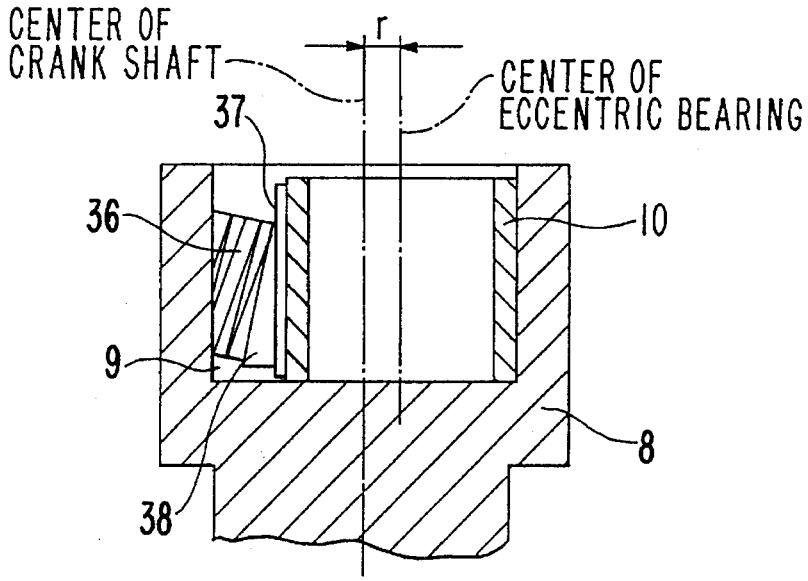
FIG. 9 is a view similar to FIG. 4, but showing a relationship between the pressure plate of FIG. 7 and the eccentric bearing of FIG. 8.

Alternatively, as shown in FIGS. 6 and 9, a coil spring 36 may be used to bias the eccentric bearing 10 radially outwardly with a pressure plate 37 interposed therebetween.

Figure 7:
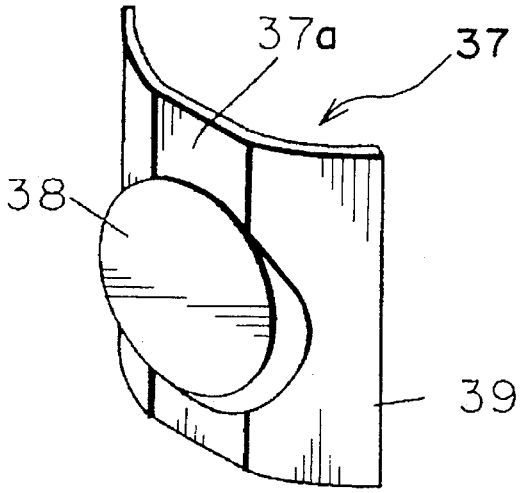
FIG. 7 is a perspective view of the pressure plate shown in FIG. 6.

As shown in FIG. 7, the pressure plate 37 is bent to have a back 37*a* and two side portions 39 continuous therewith. The back 37*a* of the pressure plate 37 has an inclined plane 38 defined thereon generally centrally thereof, which is to be held in contact with one end of the coil spring 36 to receive the biasing force thereof.

Figure 8:
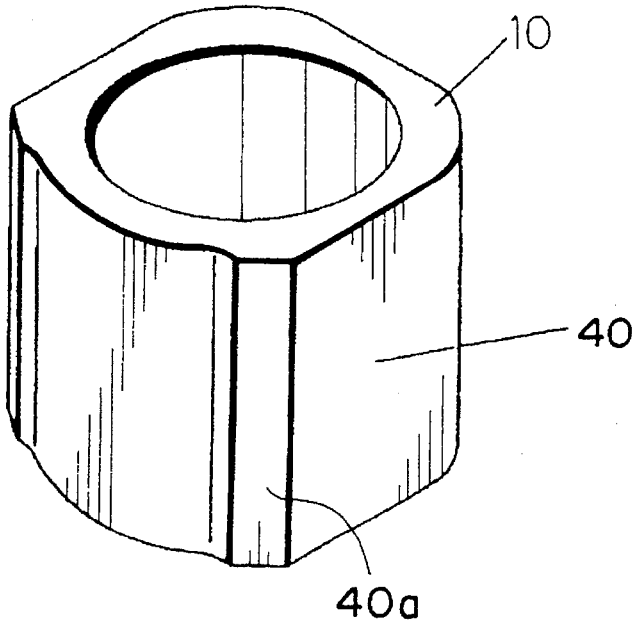
FIG. 8 is a perspective view of the eccentric bearing shown in FIG. 6.

FIG. 8 depicts an eccentric bearing 10 used in combination with the pressure plate 37 shown in FIG. 7. The eccentric bearing 10 shown in FIG. 8 has no inclined planes, unlike the eccentric bearing 10 shown in FIG. 3, but has two vertical planes 40*a* defined on thick wall portions 40 thereof located at two corners thereof, which are to be held in contact with associated side portions 39 of the pressure plate 37 to receive the biasing force of the coil spring 36.

The inclined plane 38 of the pressure plate 37 acts to direct an axial component of the biasing force of the coil spring 36 downwardly to press the eccentric bearing 10 against the bottom wall of the recess 9, thereby preventing the eccentric bearing 10 from axially moving towards the orbiting scroll 3. Because the biasing force of the coil spring 36 for maintaining the maximum orbiting radius (r) acts on the thick wall portions 40 of the eccentric bearing 10 via the side portions 39 of the pressure plate 37, the eccentric bearing 10 is unlikely to deform. Furthermore, because the inclined plane 38 is formed on the pressure plate 37 which is readily configured into a desired shape, the eccentric bearing 10 requires no inclined planes and can be simplified in its external shape. It is therefore possible to effectively manufacture the eccentric bearing 10 using an inexpensive technique such as, for example, sintering, forging, drawing or the like. It is also possible to effectively prevent sintering of the eccentric bearing 10, which has hitherto been caused by an axial movement thereof, or a reduction in clearance for the eccentric bearing 10 which has hitherto been caused by deformation thereof.

Figure 10:
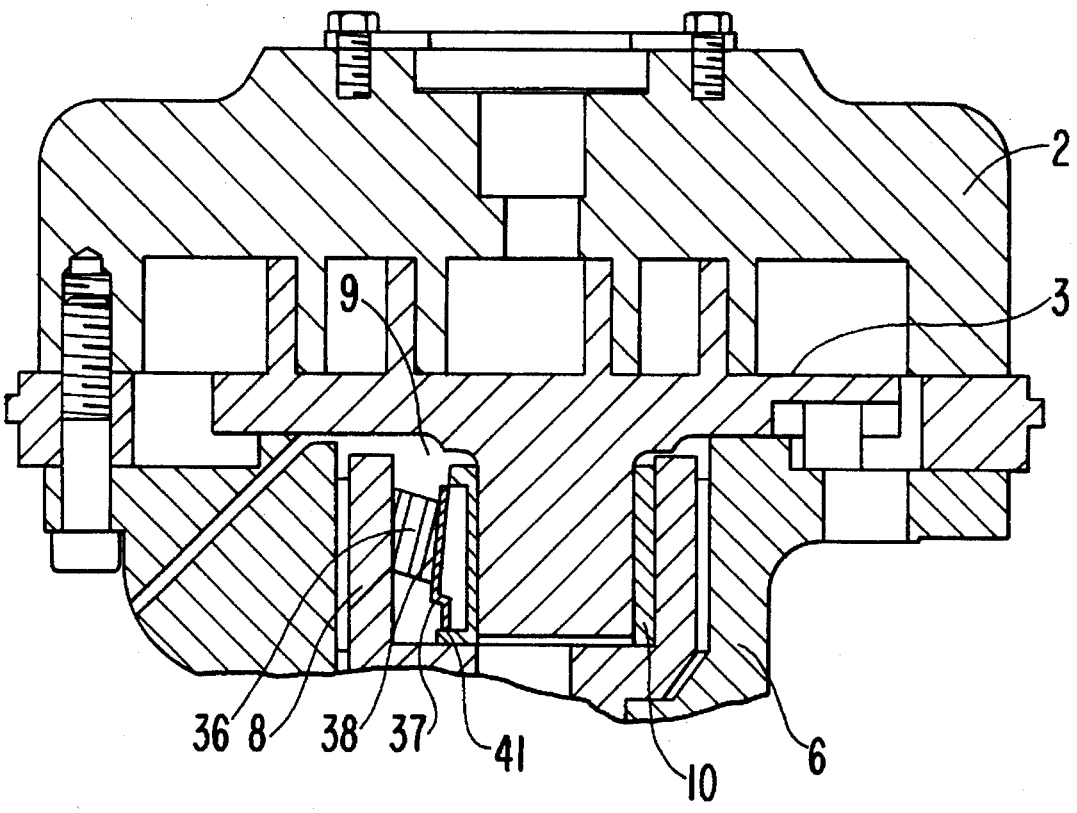
FIG. 10 is a view similar to FIG. 5, but showing a further modification thereof.
Figure 11:
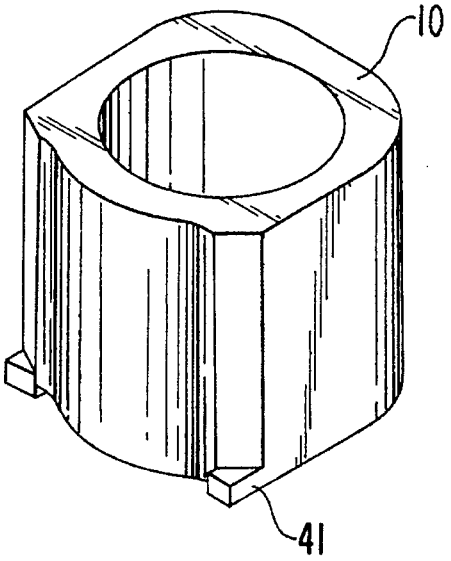
FIG. 11 is a perspective view of the eccentric bearing shown in FIG. 10.
Figure 12:
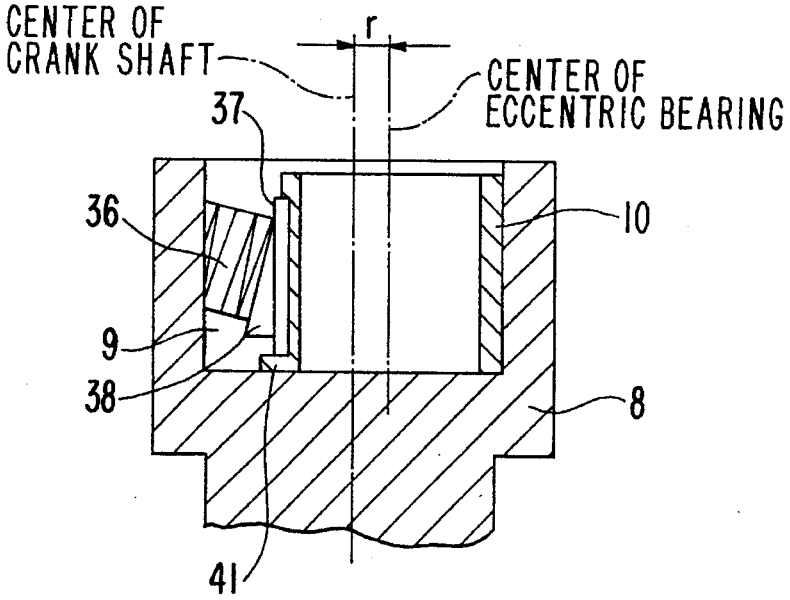
FIG. 12 is a view similar to FIG. 4, but showing a relationship between the pressure plate of FIG. 7 and the eccentric bearing of FIG. 11.

As shown in FIGS. 10 to 12, the eccentric bearing 10 may have two projections 41 formed on the lower end thereof at the thick wall portions so as to extend radially outwardly therefrom. In this case, because the lower edge of the pressure plate 37 is positively received by the projections 41 of the eccentric bearing 10, the biasing force of the coil spring 36 acts on the inclined plane 38 of the pressure plate 37, which in turn acts to effectively direct an axial component of the biasing force of the coil spring 36 downwardly with the side portions 39 of the pressure plate 37 held in contact with the vertical planes 40*a* of the eccentric bearing 10. As a result, the eccentric bearing 10 is pressed against the bottom wall of the recess 9 and is therefore prevented from axially moving towards the orbiting scroll 3.

Figure 13:
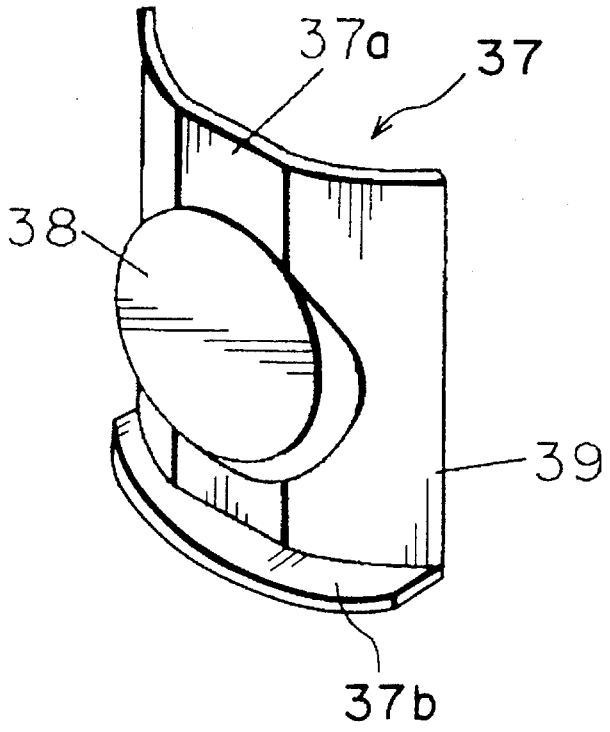
FIG. 13 is a view similar to FIG. 7, but showing a modification thereof.

The pressure plate 37 may have a rib 37*b* formed on the lower end thereof so as to extend radially outwardly therefrom, as shown in FIG. 13. The rib 37*b* rigidities the pressure plate 37 to resist deformation thereof which has been hitherto occasionally caused by the biasing force of the pressure plate 37. Without the deformation of the pressure plate 37, deformation of the eccentric bearing 10 is also avoided.

Figure 14:
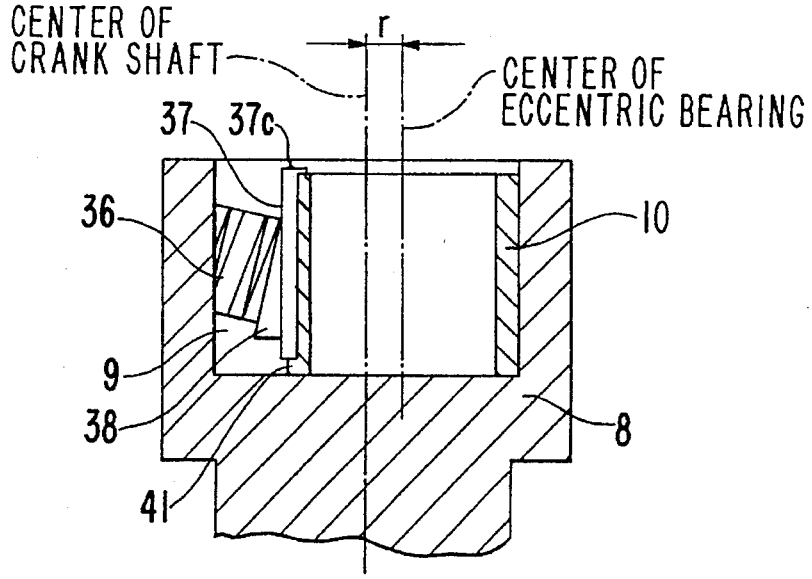
FIG. 14 is a view similar to FIG. 4, but showing a relationship between a modified pressure plate and a modified eccentric bearing.
Figure 15:
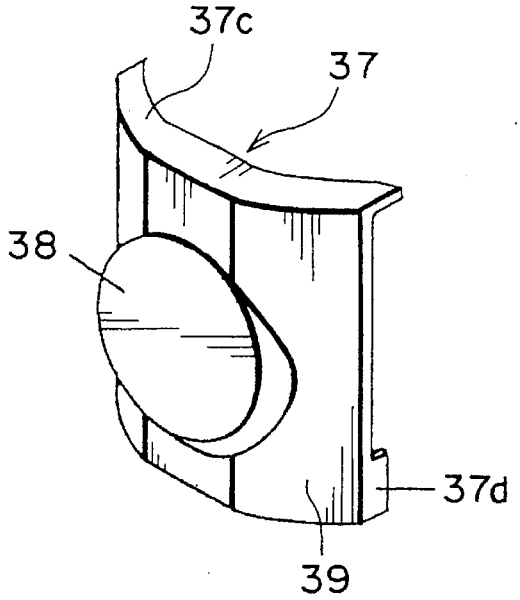
FIG. 15 is a perspective view of the pressure plate shown in FIG. 14.

Alternatively, the pressure plate 37 may have a rib 37*c* formed on the upper end thereof so as to extend radially inwardly therefrom, as shown in FIGS. 14 and 15. This pressure plate 37 also has two projections 37*d* formed on vertical edges of the side portions 39 of the pressure plate 37 at lower end portions thereof so as to extend radially inwardly therefrom. In this case, the eccentric bearing 10 is not required to have the radially outwardly extending projections 41 shown in FIG. 11, because the biasing force of the coil spring 36 acting on the inclined plate 38 of the pressure plate 37 causes the rib 37*c* to be held in contact with the upper surface of the eccentric bearing 10 to press it downwardly. On the other hand, the two projections 37*d* are held in contact with opposite outer side surfaces of the eccentric bearing 10 so as to sandwich the eccentric bearing 10 therebetween, thereby preventing a circumferential movement of the pressure plate 37.

Figure 16:
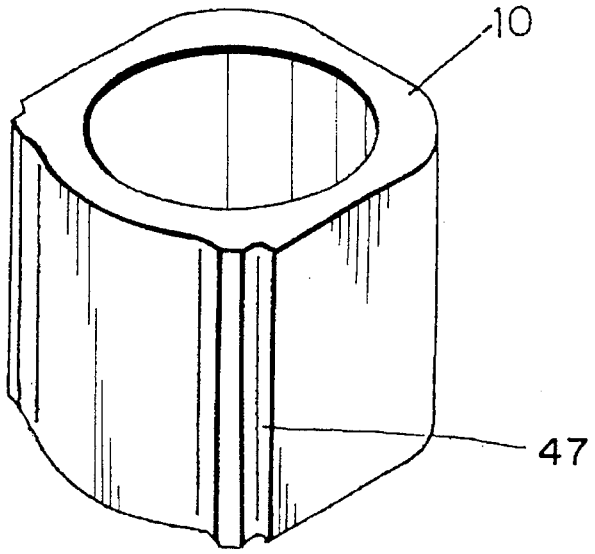
FIG. 16 is a perspective view of the eccentric bearing shown in FIG. 14.
Figure 17:
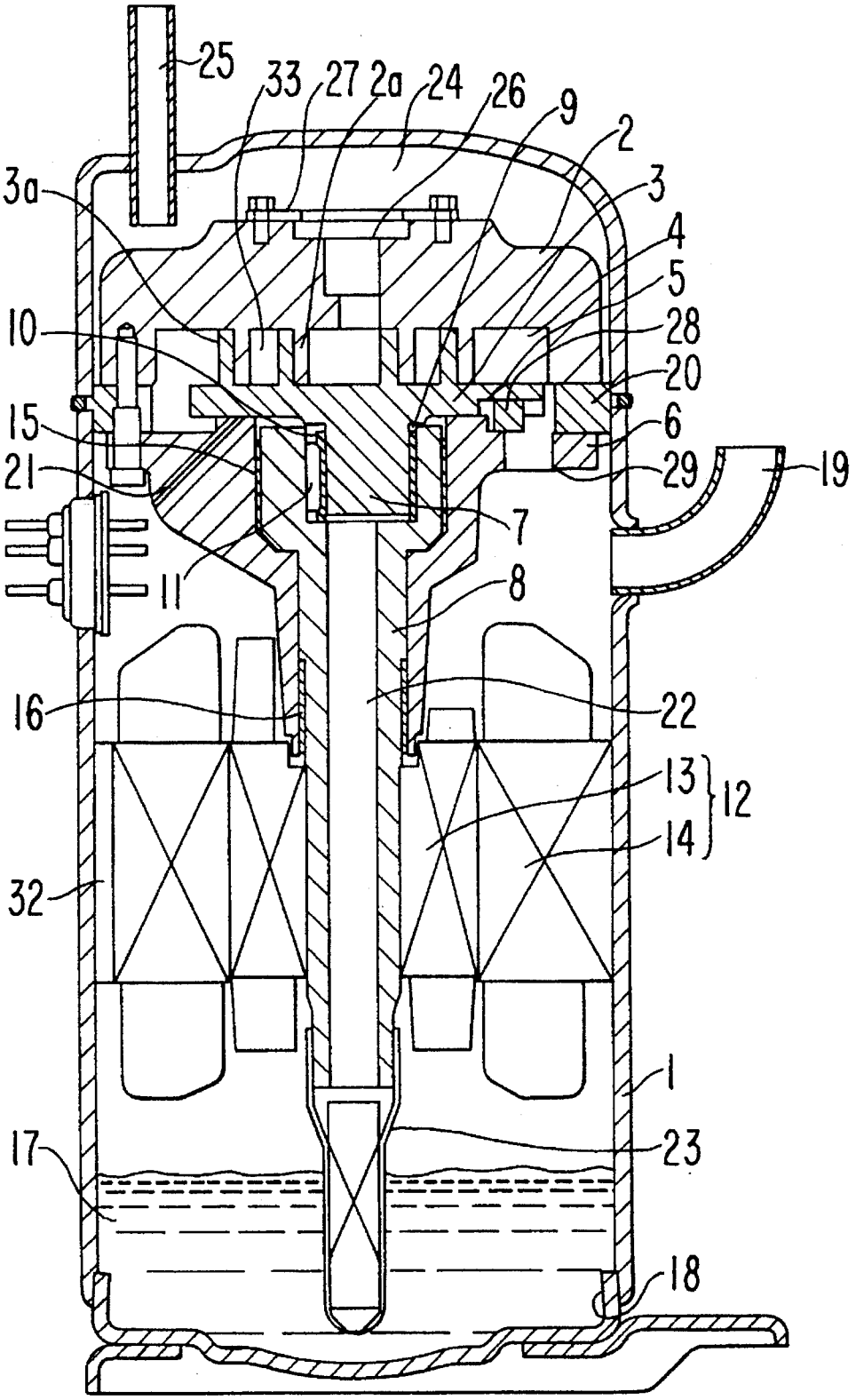
FIG. 17 (PRIOR ART)
FIG. 17 is a vertical sectional view of a conventional scroll compressor (already referred to).

FIG. 16 depicts an eccentric bearing 10 suited for use in combination with the pressure plate 37 shown in FIG. 15. This eccentric bearing 10 has two vertical recesses 47 defined therein at the thick wall portions thereof. The two vertical recesses 47 act to positively receive associated projections 37*d* of the pressure plate 37 therein to prevent a circumferential movement of the pressure plate 37 relative to the eccentric bearing 10 or relative to the recess 9 defined in the upper end portion of the crank shaft 8. As a result, an axial movement of the eccentric bearing 10 towards the orbiting scroll 3 is more effectively prevented.

The pressure plate 37 having the radially inwardly extending rib 37*c* for pressing the eccentric bearing 10 downwardly and also having the projections 37*d* for preventing a circumferential movement of the pressure plate 37 can be readily accurately manufactured by any known press work. In addition, because the eccentric bearing 10 is of a simple structure, it can be readily manufactured at a low cost.

As described hereinabove, according to the present invention, when the eccentric bearing is moved in a direction to reduce an orbiting radius of the orbiting scroll to avoid a liquid compression phenomenon and is subsequently moved in an opposite direction to return to its original position, the inclined planes formed on the eccentric bearing cause an axial component of the biasing force of the biasing means to press the eccentric bearing against the bottom wall of the recess defined in the crank shaft, thereby preventing the eccentric bearing from moving towards the orbiting scroll. Accordingly, sintering of the eccentric bearing is avoided, providing a highly reliable scroll compressor.

The provision of an inclined inner plane on the side wall of the recess can more effectively transmit the axial component of the biasing force of the biasing means to the eccentric bearing.

Where a pressure plate having an inclined plane is interposed between the biasing means and the eccentric bearing, the axial component of the biasing force is effectively transmitted to the eccentric bearing via the pressure plate without deforming the eccentric bearing.

When a pressure plate having a radially inwardly extending rib formed on the upper end thereof and two radially inwardly extending projections formed on vertical side edges thereof is employed, the axial component of the biasing force is more effectively transmitted to the eccentric bearing.

The two radially inwardly extending projections also act to prevent a circumferential movement of the pressure plate relative to the eccentric bearing.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. In a scroll compressor comprising a compression mechanism having a stationary scroll and an orbiting scroll in engagement with each other, a crank shaft for causing orbiting of the orbiting scroll relative to the stationary scroll, a bearing member for rotatably supporting the crank shaft and having a thrust bearing for axially supporting the orbiting scroll, an electric motor for driving the crank shaft, and an eccentric bearing radially movably accommodated within a recess defined in an end portion of the crank shaft, said orbiting scroll having a shaft journaled in the eccentric bearing, the improvement comprising:

a biasing means interposed between said eccentric bearing and a side wall of said recess for pressing said eccentric bearing radially outwardly; and said eccentric bearing having inclined planes defined on an external surface thereof for receiving a biasing force of said biasing means so that an axial component of the biasing force of said biasing means is directed towards said crank shaft.

2. The scroll compressor according to claim 1, wherein said side wall of said recess has an inclined plane held in contact with said biasing means to thereby effectively direct the axial component of the biasing force of said biasing means towards said crank shaft.

3. The scroll compressor according to claim 1, wherein said biasing means comprises a generally U-shaped leaf spring having a back and two side portions continuous therewith, which are held in contact with said side wall of said recess and said inclined planes of said eccentric bearing, respectively.

4. The scroll compressor according to claim 2, wherein said biasing means comprises a generally U-shaped leaf spring having a back and two side portions continuous therewith, which are held in contact with the inclined plane of said side wall of said recess and said inclined planes of said eccentric bearing, respectively.

5. In a scroll compressor comprising a compression mechanism having a stationary scroll and an orbiting scroll in engagement with each other, a crank shaft for causing orbiting of the orbiting scroll relative to the stationary scroll, a bearing member for rotatably supporting the crank shaft and having a thrust bearing for axially supporting the orbiting scroll, an electric motor for driving the crank shaft, and an eccentric bearing radially movably accommodated within a recess defined in an end portion of the crank shaft, said orbiting scroll having a shaft journaled in the eccentric bearing, the improvement comprising:

a pressure member mounted on said eccentric bearing;

a biasing means interposed between said pressure member and a side wall of said recess for pressing said eccentric bearing radially outwardly; and said pressure member having an inclined plane defined on an external surface thereof for receiving a biasing force of said biasing means so that an axial component of the biasing force of said biasing means is directed towards said crank shaft.

6. The scroll compressor according to claim 5, wherein said pressure member has a back and two side portions continuous therewith, said inclined plane being formed on said back of said pressure member, said two side portions of said pressure member being held in contact with associated side portions of said eccentric bearing.

7. The scroll compressor according to claim 6, wherein said eccentric bearing has two projections formed on a lower end thereof so as to extend radially outwardly therefrom to positively receive a lower edge of said pressure member.

8. The scroll compressor according to claim 6, wherein said pressure member has a rib formed on a lower end thereof so as to extend radially outwardly therefrom.

9. The scroll compressor according to claim 6, wherein said pressure member has a rib formed on an upper end thereof so as to extend radially inwardly therefrom to press said eccentric bearing towards said crank shaft.

10. The scroll compressor according to claim 6, wherein two projections are respectively formed on said side portions of said pressure member so as to extend radially inwardly therefrom to prevent a circumferential movement of said pressure member.

11. The scroll compressor according to claim 5, wherein said biasing means comprises a coil spring.

* * * * *